US007325447B2

(12) United States Patent
Miyahara et al.

(10) Patent No.: US 7,325,447 B2
(45) Date of Patent: Feb. 5, 2008

(54) COOLING APPARATUS FOR INTERNAL COMBUSTION ENGINE AND DIAGNOSIS METHOD FOR THE COOLING APPARATUS

(75) Inventors: Hideki Miyahara, Aichi-ken (JP); Tokiji Ito, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/494,738

(22) Filed: Jul. 28, 2006

(65) Prior Publication Data

US 2007/0034172 A1 Feb. 15, 2007

(30) Foreign Application Priority Data

Jul. 29, 2005 (JP) ..... 2005-222203

(51) Int. Cl.
*G01M 15/00* (2006.01)

(52) U.S. Cl. ..... 73/118.1

(58) Field of Classification Search ..... 73/116, 73/117.2, 117.3, 118.1, 119 R; 340/439, 340/449; 701/29, 99, 101
See application file for complete search history.

(56) References Cited

U.S. PATENT DOCUMENTS 6,321,696 B1 * 11/2001 Nishioka et al. ..... 123/41.15
6,634,219 B2 * 10/2003 Ito ..... 73/116
6,679,110 B2 * 1/2004 Oka et al. ..... 73/118.1
6,829,530 B2 * 12/2004 Mauro et al. ..... 701/114
6,907,343 B2 * 6/2005 Tsukamoto et al. ..... 701/114
6,925,376 B2 * 8/2005 Li et al. ..... 701/114
7,111,506 B2 * 9/2006 Tsukamoto et al. ..... 73/118.1
7,261,067 B2 * 8/2007 Kim ..... 123/41.15

(Continued)

FOREIGN PATENT DOCUMENTS

JP 2000-220456 8/2000
JP 2004-316638 11/2004

*Primary Examiner*—Eric S. McCall
(74) *Attorney, Agent, or Firm*—Oblon, Spivak, McClelland, Maier & Neustadt, P.C.

(57) ABSTRACT

A cooling apparatus for an engine is provided with a thermostat operating in such a manner as to control a supply of a coolant to a radiator. An electronic control apparatus estimates a reference temperature corresponding to a temperature of the coolant on the basis of at least a vehicle speed, and diagnoses an operating state of the thermostat on the basis of a comparison between a detected value of the coolant temperature and the reference temperature. The electronic control apparatus inhibits the diagnosis of the operating state of the thermostat in the case that any one of the following conditions i) to iii) is satisfied.

i) a rate of a descending slope traveling time of a vehicle with respect to a time until the diagnosis condition is established from the start of the internal combustion engine is greater than or equal to a determination value;

ii) a rate of the descending slope traveling time with respect to a general traveling time is greater than or equal to a determination value; and iii) a rate of a time of a specific state (a state in which a speed of the vehicle is greater than or equal to a reference vehicle speed and a load of the internal combustion engine is less than a reference load) with respect to the time until the diagnosis condition is established from the start of the internal combustion engine is greater than or equal to a determination value.

16 Claims, 12 Drawing Sheets

U.S. PATENT DOCUMENTS

2002/0157620 A1* 10/2002 Kastner et al. ..... 123/41.1
2004/0129067 A1* 7/2004 Mauro et al. ..... 73/118.1
2004/0173012 A1* 9/2004 Tsukamoto et al. ..... 73/118.1
2005/0097946 A1* 5/2005 Wakahara et al. ..... 73/118.1
2007/0033998 A1* 2/2007 Wakahara et al. ..... 73/118.1

* cited by examiner

COOLING APPARATUS FOR INTERNAL COMBUSTION ENGINE AND DIAGNOSIS METHOD FOR THE COOLING APPARATUS

BACKGROUND OF THE INVENTION

The present invention relates to a cooling apparatus for an internal combustion engine for executing a diagnosis of an operating state of a thermostat and a diagnosis method for the cooling apparatus In the internal combustion engine, there can be generated a phenomenon (stuck-open valve) that a valve within the thermostat is not operated in an open state. In the state in which the stuck-open valve is generated, since coolant is always circulated via a radiator, a temperature of the coolant is hard to be increased in comparison with a normal state of the thermostat.

Accordingly, in a conventional cooling apparatus including a cooling apparatus described in Japanese Laid-Open Patent Publication No. 2000-220456, the configuration is made such that an abnormality of the thermostat is detected such as the following items (A) and (B) while paying attention to a difference of a temperature transition of the coolant between a normal state and an abnormal state of the thermostat.

(A) A reference temperature corresponding to a coolant temperature at a time when the thermostat is normal is calculated on the basis of a parameter having a correlation with the cooling temperature. Further, at a time of calculating the reference temperature, a vehicle speed having a correlation with a relative wind is added while taking into consideration a fact that the coolant temperature is affected by the relative wind.

(B) When the diagnosis condition is established, an operating state of the thermostat is diagnosed through a comparison between the reference temperature and an actual cooling temperature. That is, when an ascending degree of the reference temperature is larger than an ascending degree of the coolant temperature, it is determined that an abnormality is generated in the thermostat.

In a cooling apparatus described in Japanese Laid-Open Patent Publication No. 2004-316638, the configuration is made such that the influence of the relative wind applied to the coolant temperature is reflected on the reference temperature by correcting the reference temperature on the basis of the vehicle speed.

However, it has been confirmed through a test or the like executed by the present inventors that the affecting degree of the relative wind applied to the coolant temperature is greatly different between a case in which the traveling state of the vehicle is in a slope descending state and other traveling states. Accordingly, in the cooling apparatus in Japanese Laid-Open Patent Publication No. 2004-316638, in the case that the slope descending state of the vehicle is continued for a comparatively long period before the diagnosis condition is established, there is a possibility that the reference temperature is largely deviated from an essentially set value, and an abnormality of the thermostat is erroneously detected.

SUMMARY OF THE INVENTION

Accordingly, it is an objective of the present invention to provide a cooling apparatus for an internal combustion engine which can improve a detecting accuracy of an abnormality of a thermostat, and a diagnosis method of the cooling apparatus.

In order to achieve the object mentioned above, the present invention provides a cooling apparatus for an internal combustion engine. The cooling apparatus is provided with a radiator through which a coolant passes, a thermostat operating in such a manner as to control a supply of the coolant to the radiator, a temperature detector detecting a temperature of the coolant, an estimating section estimating a reference temperature corresponding to the temperature of the coolant on the basis of at least a vehicle speed, and an diagnosing section diagnosing an operating state of the thermostat on the basis of a comparison between the detected temperature and the reference temperature in the case that a predetermined diagnosis condition is established.

In accordance with one aspect of the present invention, the cooling apparatus is further provided with an inhibiting section inhibiting the diagnosis of the operating state of the thermostat in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

On the other hand, the cooling apparatus in accordance with another aspect of the present invention is provided with a correcting section correcting the reference temperature in the case that any one of the conditions i) to iii) mentioned above is satisfied, in place of the inhibiting section mentioned above.

The present invention further provides a diagnosis method of a cooling apparatus for an internal combustion engine. The cooling apparatus is provided with a radiator through which a coolant passes, and a thermostat operating in such a manner as to control a supply of the coolant to the radiator. The diagnosis method is provided with the steps of detecting a temperature of the coolant, estimating a reference temperature corresponding to the temperature of the coolant on the basis of at least a vehicle speed, and diagnosing an operating state of the thermostat on the basis of a comparison between the detected temperature and the reference temperature in the case that a predetermined diagnosis condition is established.

In accordance with another aspect of the present invention, the diagnosis method is further provided with a step of inhibiting the diagnosis of the operating state of the thermostat in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

The diagnosis method in accordance with the other aspect of the present invention is provided with a step of correcting the reference temperature in the case that any one of the conditions i) to iii) mentioned above is satisfied, in place of the inhibiting step mentioned above.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

First Embodiment

A description will be given of a first embodiment in accordance with the present invention with reference to FIGS. 1 to 11.

<Configuration of Vehicle>

Figure 1:
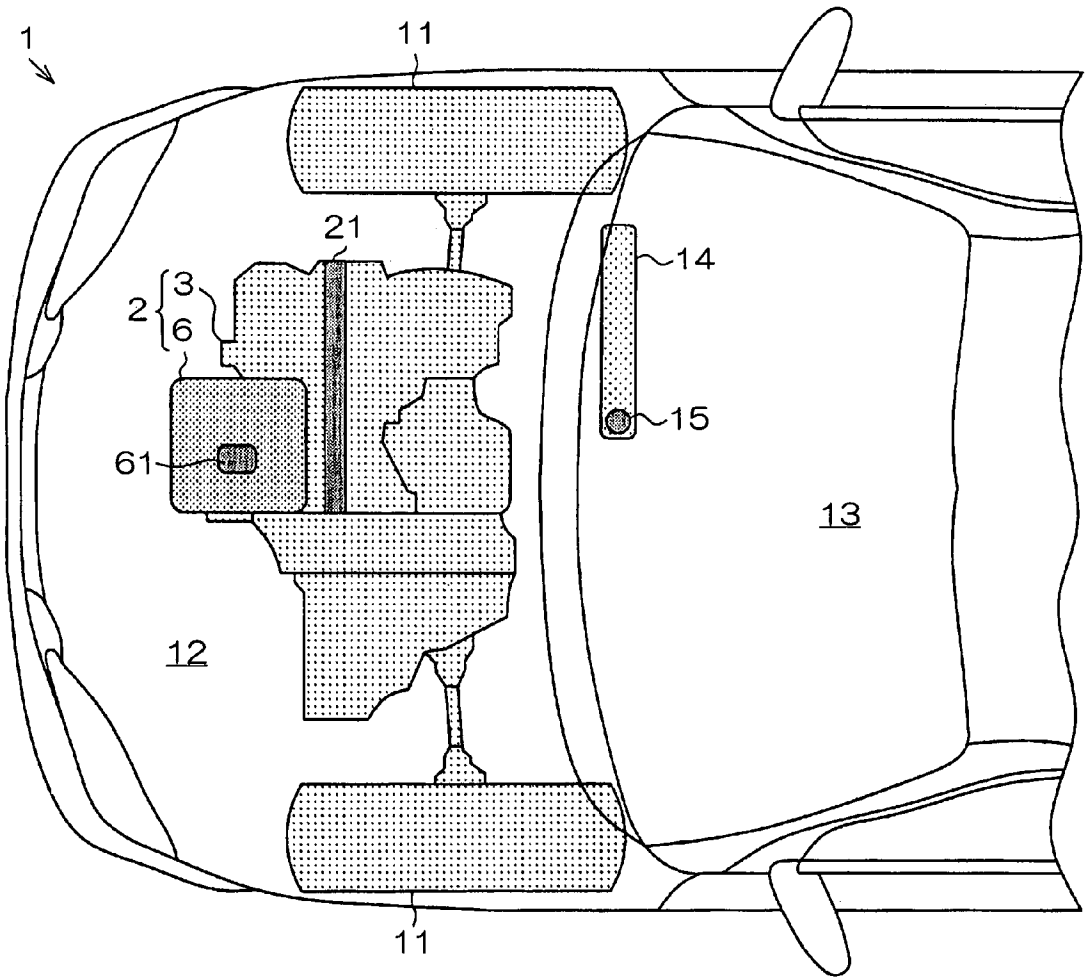
FIG. 1 is a plan view showing a vehicle on which a cooling apparatus in accordance with a first embodiment of the present invention is mounted.

As shown in FIG. 1, a vehicle 1 travels through rotation of wheels 11 generated by a crankshaft 21 of an engine 2. The engine 2 is mounted within an engine compartment 12 of the vehicle 1, and is provided with an engine main body 3 and a cooling apparatus 6. A cabin 13 of the vehicle 1 is provided with an indicator panel 14 displaying a state of the vehicle 1 and the engine 2.

The indicator panel 14 is provided with a warning lamp 15 displaying an abnormality of an operating state of a thermostat 61 provided in the cooling apparatus 6. The warning lamp 15 is turned on at a time when the abnormality of the operating state is detected through a diagnosing apparatus mentioned below.

<Configuration of Engine>

Figure 2:
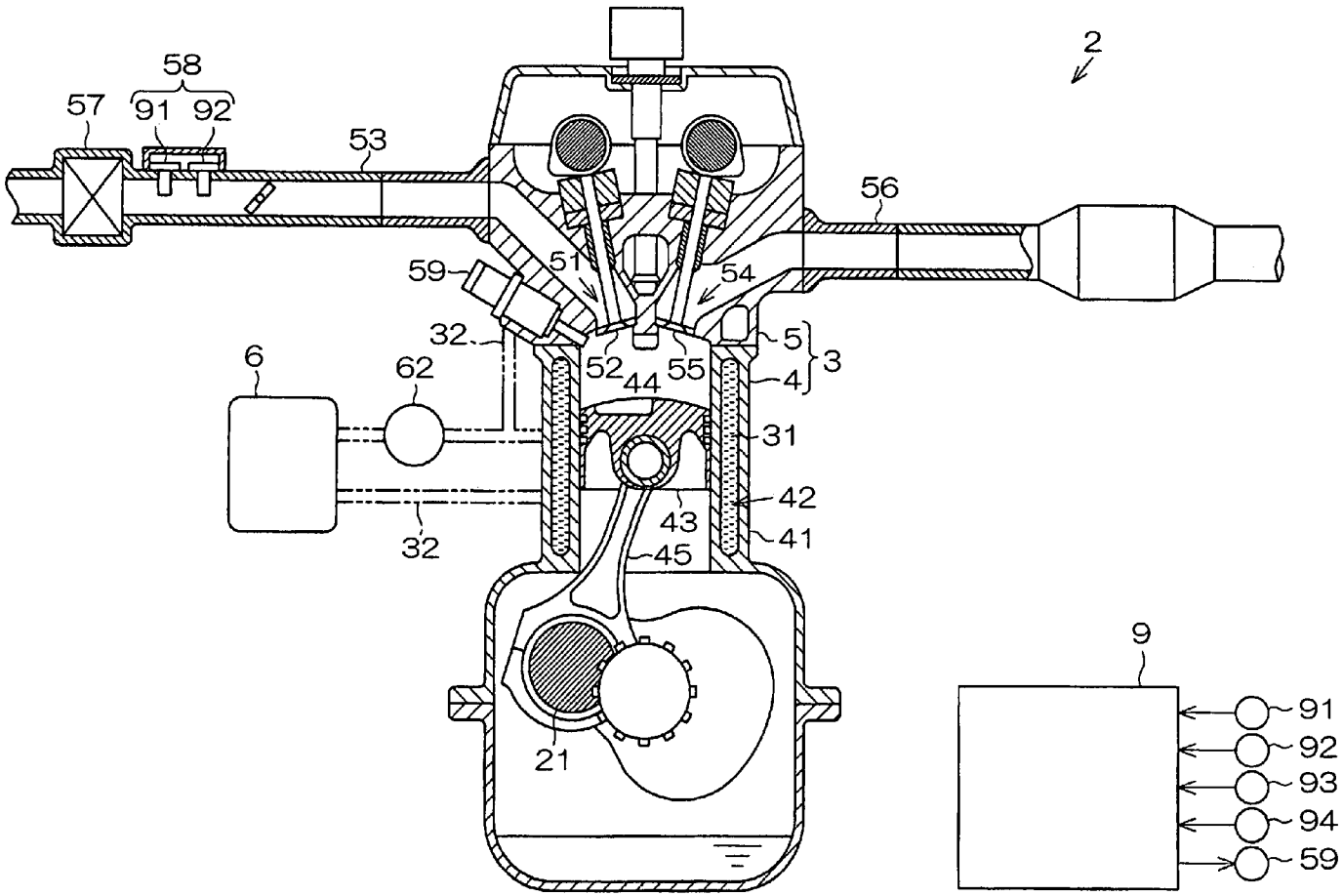
FIG. 2 is a cross-sectional view of an internal combustion engine mounted on the vehicle in FIG. 1.

As shown in FIG. 2, an engine main body 3 is provided with a cylinder block 4 and a cylinder head 5. In the engine main body 3, there is formed a passage (a main body coolant passage 32) for supplying a coolant 31 to the cylinder block 4 and the cylinder head 5.

A flow of the coolant 31 is formed within the engine 2 by a water pump 62 of the cooling apparatus 6. The water pump 62 is driven by the crankshaft 21. The water pump 62 draws the coolant 31 within the cooling apparatus 6 and thereafter discharges the coolant 31 to the main body coolant passage 32.

The cylinder block 4 is provided with a plurality of (only one being illustrated) cylinders 41. A water jacket 42 is formed around the cylinders 41. The water jacket 42 forms a part of the main body coolant passage 32.

A piston 43 is arranged within each of the cylinders 41. A space surrounded by an inner circumferential surface of the cylinder 41, a top surface of the piston 43 and the cylinder head 5 forms a combustion chamber 44. The piston 43 is coupled to the crankshaft 21 via a connecting rod 45.

The cylinder head 5 is provided with an intake valve 52 opening and closing an intake port 51, and an exhaust valve 55 opening and closing an exhaust port 54, in correspondence to each of the cylinders 41. To the intake port 51, there is connected an intake pipe 53 circulating air in an outer portion toward the combustion chamber 44. To the exhaust port 54, there is connected an exhaust pipe 56 circulating a gas flowing out from the combustion chamber 44 toward an outer portion.

An air cleaner 57 is provided in the intake pipe 53. A sensor unit 58 is provided in a downstream side of the air cleaner 57 and near the air cleaner 57. The sensor unit 58 is provided with an intake temperature sensor 91 and an air flowmeter 92. That is, the intake temperature sensor 91 and the air flowmeter 92 are provided within a casing of the sensor unit 58. In this case, a hotwire air flowmeter is employed as the air flowmeter 92.

In the cylinder head 5, an injector 59 is provided at a position facing each of the combustion chambers 44. The injector 59 directly injects a fuel into the combustion chamber 44.

The engine 2 is overall controlled by an electronic control unit 9. The electronic control unit 9 is provided with a central computation process apparatus executing a computation process in accordance with an engine control, a read only memory previously storing a program and a map necessary for the engine control, a random access memory temporarily storing results of computation of the central computation process apparatus and the like, a backup memory capable of storing a data such as results of computation and the like even during stop of the engine 2, an input port for inputting a signal from the outer portion, and an output port for outputting the signal to the outer portion. The electronic control unit 9 functions as an estimating section, a diagnosing section and an inhibiting section (a suspension section).

To the input port of the electronic control unit 9, there is connected the temperature sensor 91, the air flowmeter 92, a coolant temperature sensor 93 (a coolant temperature detector) and a vehicle speed sensor 94. Further, a drive device such as an injector 59 or the like is connected to the output port of the electronic control unit 9.

The intake temperature sensor 91 is provided in the intake pipe 53, and outputs an electric signal in correspondence to a temperature of the air within the intake pipe 53 (an intake temperature THA). The output signal of the intake temperature sensor 91 is input to the electronic control unit 9, and is thereafter used for various types of controls as an intake temperature measured value THAM.

The air flowmeter 92 is provided in the intake pipe 53, and outputs an electric signal in correspondence to a flow rate of the air within the intake pipe 53. The output signal of the air flowmeter 92 is input to the electronic control unit 9, and is thereafter used for various types of controls as an intake flow rate measured value GAM. The intake flow rate GA corresponds to an amount (an intake air amount) of the air supplied into the combustion chamber 44.

The coolant temperature sensor 93 is provided around the cylinder 41, and outputs an electric signal in correspondence to a temperature (a coolant temperature THW) of the coolant 31 within a water jacket 42. An output signal of the coolant temperature sensor 93 is input to the electronic control unit 9, and is thereafter used for various types of controls as a coolant temperature measured value THWM.

The vehicle speed sensor 94 is provided near a wheel 11 of the vehicle 1, and outputs an electric signal in correspondence to a rotating speed (a vehicle speed SPD) of the wheel 11. The output signal of the vehicle speed sensor 94 is input to the electronic control unit 9, and is thereafter used for various types of controls as a vehicle speed measured value SPDM.

The electronic control unit 9 executes various types of engine controls on the basis of the detected data or the like of the various types of sensors. For example, in the fuel injection control, there is executed a control of adjusting a fuel injection amount of the injector 59 in correspondence to the intake flow rate GA.

<Sconfiguration of Cooling Apparatus>

Figure 3:
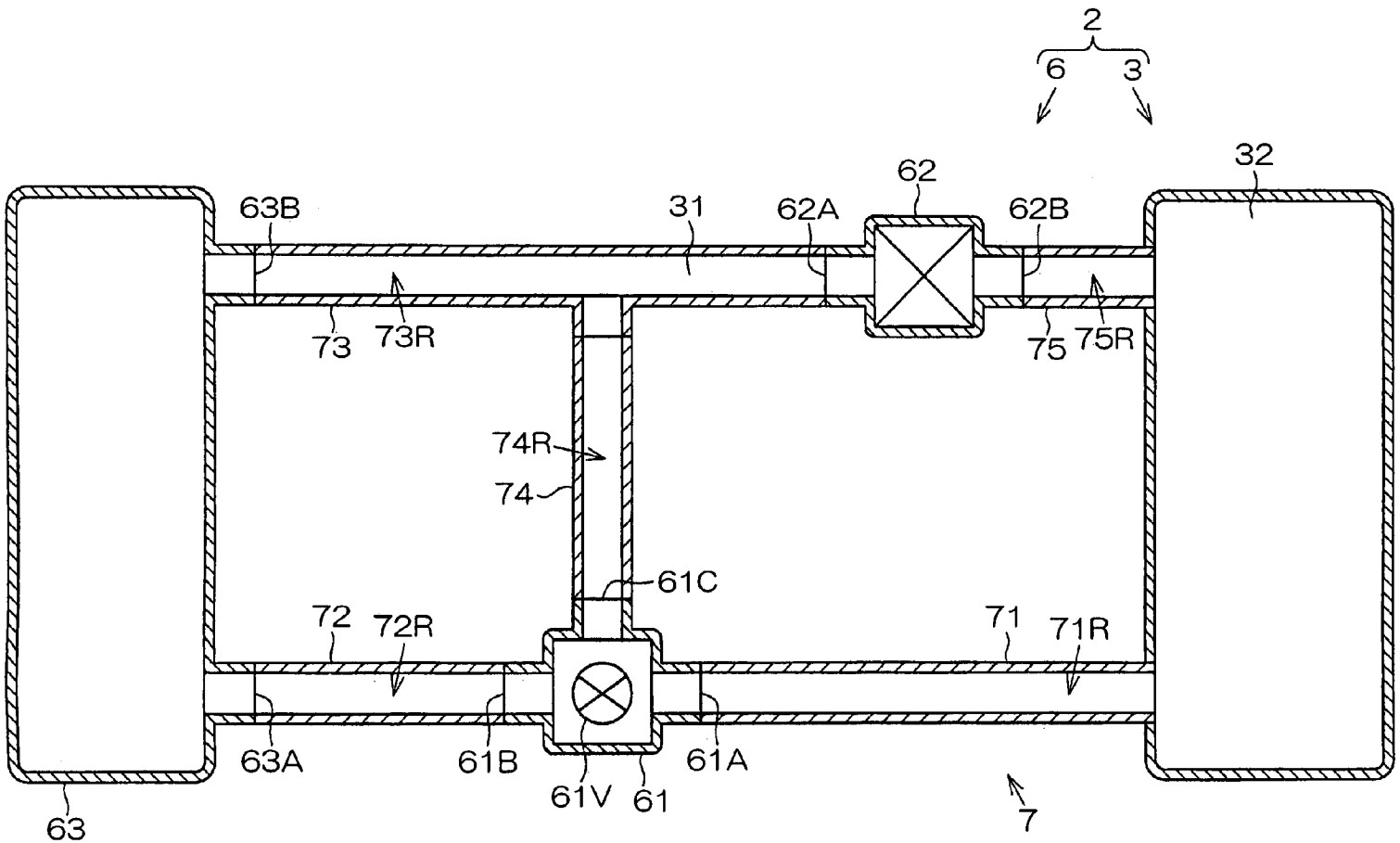
FIG. 3 is a cross-sectional view showing the entire configuration of the cooling apparatus in accordance with the first embodiment.

As shown in FIG. 3, the cooling apparatus 6 is provided with a thermostat 61, a water pump 62 and a radiator 63.

The thermostat 61 allows an inflow of the coolant 31 via a coolant inlet 61A, and changes a circulating path of the coolant 31 by a thermostat valve 61V. That is, the thermostat 61 is provided with a first coolant outlet 61B and a second coolant outlet 61C as an outlet of the coolant 31. The first coolant outlet 61B is opened or closed in correspondence to an opened or closed state of the thermostat valve 61V. On the other hand, the second coolant outlet 61C is always opened regardless of the opened or closed state of the thermostat valve 61V.

In the thermostat 61, the thermostat valve 61V is opened at a time when the temperature of the coolant 31 is greater than or equal to the valve opening temperature THWT, whereby the first coolant outlet 61B is opened. On the other hand, the thermostat valve 61V is closed at a time when the temperature of the coolant 31 is less than the valve opening temperature THWT, whereby the first coolant outlet 61B is closed.

The radiator 63 exchanges a heat of the coolant 31 flowing into an inner portion via the coolant inlet 63A with respect to an ambient air. The coolant 31 heat exchanged by the radiator 63 is circulated to the engine main body 3 via the coolant outlet 63B.

The engine main body 3 and constituting elements of the cooling apparatus 6 are connected as follows through a coolant supply pipe 7.

[A] The main body coolant passage 32 of the main body 3 and the coolant inlet 61A of the thermostat 61 are connected by a first coolant supply pipe 71. That is, the coolant flowing out from the main body coolant passage 32 flows into the thermostat 61 via a passage (a first coolant passage 71R) within the first coolant supply pipe 71.

[B] The first coolant outlet 61B of the thermostat 61 and the coolant inlet 63A of the radiator 63 are connected by a second coolant supply pipe 72. That is, the coolant 31 flowing out from the first coolant outlet 61B is supplied to the radiator 63 via a passage (a second coolant passage 72R) within the second coolant supply pipe 72.

[C] The coolant outlet 63B of the radiator 63 and the suction port 62A of the water pump 62 are connected by a third coolant supply pipe 73. That is, the coolant 31 flowing out from the coolant outlet 63B is drawn by the water pump 62 via a passage (a third coolant passage 73R) within the third coolant supply pipe 73.

[D] The second coolant outlet 61C of the thermostat 61 and the third coolant supply pipe 73 are connected by a fourth coolant supply pipe 74. That is, the coolant 31 flowing out from the second coolant outlet 61C is drawn by the water pump 62 via a passage (a fourth coolant passage 74R) within the fourth coolant supply pipe 74.

[E] The outlet 62B of the water pump 62 and the main body coolant passage 32 of the engine main body 3 are connected by a fifth coolant supply pipe 75. That is, the coolant 31 discharged from the water pump 62 is supplied to the engine main body 3 via a passage (a fifth coolant passage 75R) within the fifth coolant supply pipe 75.

In the engine 2, a coolant circuit for circulating the coolant 31 between the engine main body 3 and the cooling apparatus 6 is formed by the main body coolant passage 32 and the first to fifth coolant passages 71R to 75R.

The coolant circuit includes a first circuit and a second circuit. The first circuit is formed by the main body coolant passage 32, the first coolant passage 71R, the second coolant passage 72R, the third coolant passage 73R and the fifth coolant passage 75R. In the first circuit, the coolant 31 circulates between the engine main body 3 and the cooling apparatus 6 via the radiator 63. The second circuit is formed by the main body coolant passage 32, the first coolant passage 71R, the fourth coolant passage 74R, the third coolant passage 73R and the fifth coolant passage 75R. In the second circuit, the coolant 31 circulates between the engine main body 3 and the cooling apparatus 6 without passing through the radiator 63.

<Circulating Patterns of Coolant>

A description will be given of circulating patterns of the coolant 31 with reference to FIGS. 4 and 5. In this case, in FIGS. 4 and 5, a coolant passage shown by a solid line indicates a passage in which a coolant flow is formed, and a coolant passage shown by a broken line indicates a passage in which the coolant flow is not formed, respectively.

Figure 4:
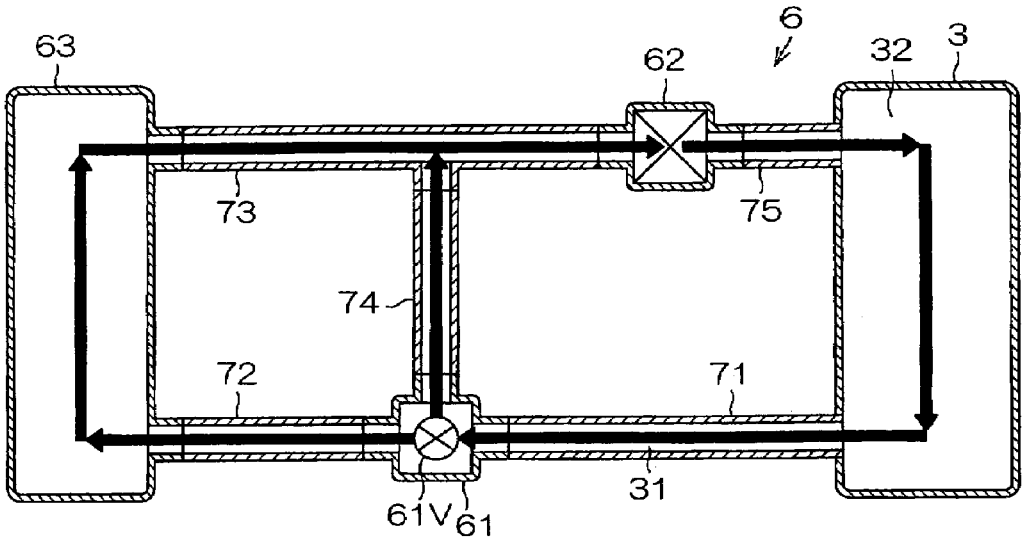
FIG. 4 is a view showing one example of a circulating pattern of a coolant in the cooling apparatus in FIG. 3.

FIG. 4 shows a first circulating pattern of the coolant 31. Since the thermostat valve 61V is opened at a time when the temperature of the coolant 31 is greater than or equal to the valve opening temperature THWT, the first circuit and the second circuit are in an opened state. Accordingly, the coolant 31 is circulated through the first circuit and the second circuit.

Figure 5:
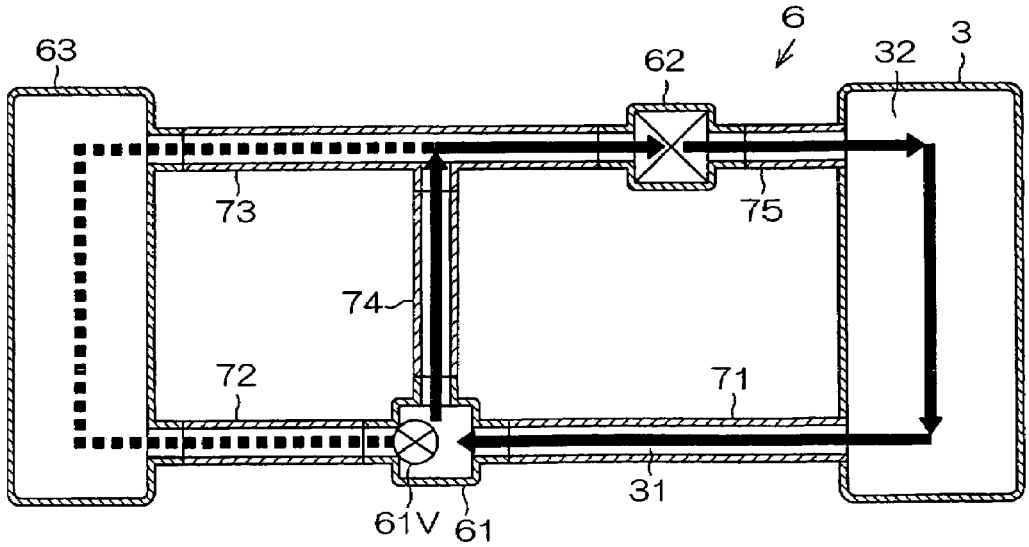
FIG. 5 is a view showing one example of the circulating pattern of the coolant in the cooling apparatus in FIG. 3.

FIG. 5 shows a second circulating pattern of the coolant 31. Since the thermostat valve 61V is closed at a time when the temperature of the coolant 31 is less than the valve opening temperature THWT, the first circuit is closed and the second circuit is in the opened state. Accordingly, the coolant 31 is circulated only through the second circuit.

<Failure of Thermostat>

In the thermostat 61, there can be generated a phenomenon (stuck-open valve) in which the thermostat valve 61V is not operated under the opened state. In this state in which the stuck-open valve is generated, since the first circuit is held in the opened state regardless of the temperature of the coolant 31, the coolant 31 is always circulated via the radiator 63. Accordingly, in the case that the stuck-open valve of the thermostat 61 is generated, the temperature of the coolant 31 is hard to be increased in comparison with the case that the abnormality of the thermostat 61 is not generated. Therefore, for example, a deterioration of an exhaust emission or the like is caused by an excessive lowering of the temperature of the coolant 31.

Accordingly, in the cooling apparatus 6 of the present embodiment, when the operating state of the thermostat 61 is diagnosed during the operation of the engine 2, and the abnormality (the stuck-open valve) of the thermostat 61 is detected through the diagnosis, the abnormality of the thermostat 61 is notified to a driver through a lighting of a warning lamp 15. In this case, in the present embodiment, a state in which the stuck-open valve is generated in the thermostat 61 is set to an abnormal state of the thermostat 61, and a state in which the stuck-open valve is not generated in the thermostat 61 is set to a normal state of the thermostat 61.

<Abnormality Diagnosis Method of Thermostat>

Figure 6:
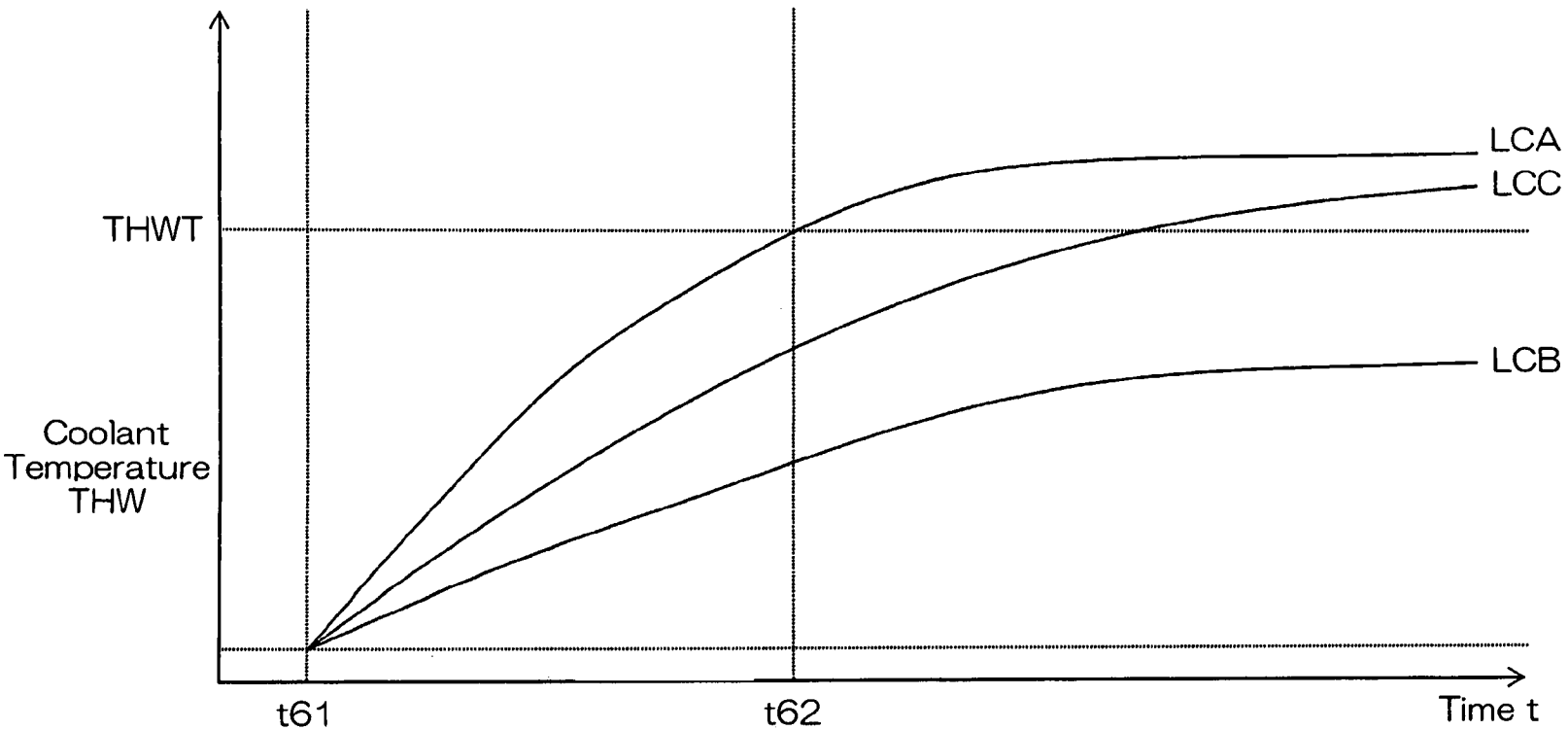
FIG. 6 is a graph showing one example of a temperature change of the coolant in the cooling apparatus in FIG. 3.

FIG. 6 shows a transition of the temperature of the coolant 31 in each of the normal state and the abnormal state of the thermostat 61. In this case, in FIG. 6, time t61 indicates a point in time when the operation of the engine 2 is started, and time t62 indicates a point in time when the temperature of the coolant 31 reaches the valve opening temperature THWT at the normal state of the thermostat 61.

Since the coolant 31 is always circulated via the radiator 63 as mentioned above, at the abnormal state of the thermostat 61, the temperature of the coolant 31 indicates a lower temperature than the valve opening temperature THWT even at a timing when the temperature of the coolant 31 reaches the valve opening temperature THWT at the normal state of the thermostat 61.

In the cooling apparatus 6 in accordance with the present embodiment, the abnormality of the thermostat 61 is detected as mentioned below by paying attention to the difference of the temperature transition of the coolant 31 between the normal state and the abnormal state of the thermostat 61.

(A) On the assumption that the operating state of the thermostat 61 is normal, the temperature change of the coolant 31 is simulated on the basis of a parameter affecting the temperature of the coolant 31. In this case, in the present embodiment, the temperature of the coolant 31 simulated as mentioned above, is set to a coolant temperature simulated value (reference temperature) THWE.

(B) When the diagnosis condition is established, the operating state of the thermostat 61 is diagnosed through a comparison between the coolant temperature simulated value THWE and an actual temperature of the coolant 31 (a coolant temperature THW detected through a coolant temperature sensor 93). That is, when a temperature ascending degree of the coolant temperature simulated value THWE is greater than a temperature ascending degree of the coolant temperature measured value THWM, it is determined that the abnormality is generated in the thermostat 61.

<Calculating Method of Coolant Temperature Simulated Value>

In the present embodiment, there is executed an updating of the coolant temperature simulated value THWE in the following manner, during the operation of the engine 2. That is, there is calculated a change amount of the coolant temperature simulated value THWE (a simulated water temperature change amount ΔTHWE), that is, a value corresponding to the temperature change amount of the coolant 31 at the normal state of the thermostat 61, per a predetermined computing cycle. Further, the coolant temperature simulated value THWE is updated to a value complying with an operating state or the like at that time by reflecting the simulate water temperature change amount ΔTHWE on the coolant temperature simulated value THWE.

<Calculating Method of Simulated Water Temperature Change Amount>

In the present embodiment, as the parameter affecting the temperature change of the coolant 31, the following parameter (A) to (C) are employed. Further, it is possible to calculate a proper simulated water temperature change amount ΔTHWE in correspondence to the traveling state of the vehicle 1 and the operating state of the engine 2, by previously adapting the parameters and the simulated water temperature change amount ΔTHWE to each other.

(A) Load of engine: In the engine 2, the greater its load (an engine load LE) is, the more a calorific power generated in accordance with the combustion of the fuel is, so that there is shown a tendency that the temperature of the coolant 31 becomes higher. Accordingly, in the present embodiment, the the engine load LE and the simulated water temperature change amount ΔTHWE are previously adapted to each other, and the calculation of the simulated water temperature change amount ΔTHWE is executed on the basis of this relation. In this case, the present embodiment employs an intake air rate GAP, that is, a rate between an intake flow rate measured value GAM and a maximum intake flow rate GAmax as the engine load LE. The maximum intake flow rate GAmax corresponds to a maximum intake flow rate GA obtained in the engine operating state at that time.

(B) Traveling speed of vehicle: In the engine 2, the higher a vehicle speed SPD is, the more a heat exchange of the coolant 31 in the radiator 63 is promoted, so that there is shown a tendency that the temperature of the coolant 31 is hard to be increased. Accordingly, in the present embodiment, the vehicle speed SPD and the simulated water temperature change amount ΔTHWE are previously adapted to each other, and the calculation of the simulated water temperature change amount ΔTHWE is executed on the basis of this relation.

(C) Temperature difference from ambient air: In the engine 2, the more the temperature difference (the temperature difference DfTHWA from the ambient air) between the coolant 31 and the ambient air is, the more a heat radiation of the coolant 31 is promoted, so that there is shown a tendency that the temperature of the coolant 31 is hard to be increased. Accordingly, in the present embodiment, the temperature difference DfTHWA from the ambient air and the simulated water temperature change amount ΔTHWE are previously adapted to each other, and the calculation of the simulated water temperature change amount ΔTHWE is executed on the basis of this relation.

In the engine 2, since it is impossible to directly detect the actual ambient air temperature, the ambient air temperature is obtained through the intake temperature measured value THAM. Further, since a closest value to the ambient air temperature is basically indicated by a minimum intake temperature measured value THAMmin (a smallest value of the intake temperature measured values THAM obtained from the start of the engine 2 until now) in the intake temperature measured value THAM, the minimum intake temperature measured value THAMmin is employed as a value corresponding to the ambient air temperature. That is, the present embodiment employs a value (an intake temperature difference DfTHWB from the intake air) obtained by subtracting the minimum intake temperature measured value THAMmin from the coolant temperature simulated value THWE as the temperature difference DfTHWA from the ambient air.

<Operating State Diagnosing Process>

In the engine 2 in accordance with the present embodiment, an operating state diagnosing process is executed as a process for diagnosing the operating state of the thermostat 61. The operating state diagnosing process is repeatedly executed per a predetermined computing cycle through the electronic control unit 9. A description will be given of a detailed procedure of the operating state diagnosing process with reference to FIGS. 7 to 11.

Figure 7:
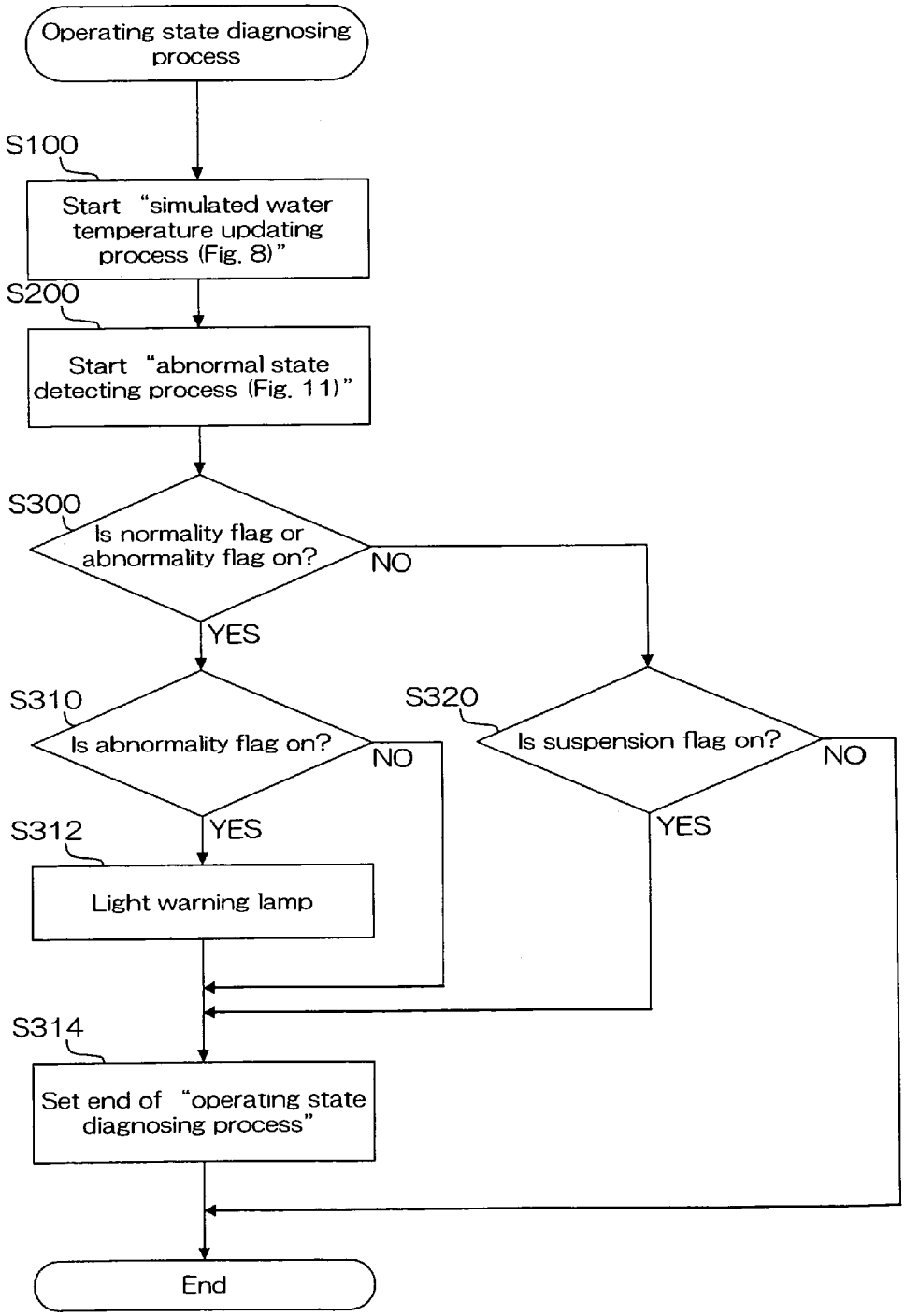
FIG. 7 is a flowchart showing a procedure of an operating state diagnosing process executed in the first embodiment.

As shown in FIG. 7, a simulated water temperature updating process (refer to FIG. 8) for updating the coolant temperature simulated value THWE is started in step S100. After the end of the simulated water temperature updating process, the process goes to step S200.

In step S200, an abnormal state detecting process (refer to FIG. 11) for detecting an abnormality of the thermostat 61 on the basis of the coolant temperature measured value THWM and the coolant temperature simulated value THWE is started. After the end of the abnormal state detecting process, the process goes to step S300.

In step S300, it is judged whether or not the diagnosis of the operating state of the thermostat 61 is executed in the abnormal state detecting process. That is, it is judged whether or not any one of a flag (an abnormality diagnosis flag FA) indicating that the operating state of the thermostat 61 is abnormal, and a flag (a normality diagnosis flag FB) indicating that the operating state of the thermostat is normal is set to an on state. When any one of the flags is set to the on state, the process goes step S310. When both of the flags are not set to the on state, the proces goes to step S320.

In step S310, it is judged whether or not the abnormality diagnosis flag FA is set to the on state. When the abnormality diagnosis flag FA is set to the on state, the process goes to a process in step S312. When the normality diagnosis flag FB is set to the on state, the process goes to step S314.

In step S312, the warning lamp 15 is turned on. In step S314, the end of the operating state diagnosing process is set. Accordingly, the operating state diagnosing process is finished together with the end of the process in step S314.

In step S320, it is judged whether or not the diagnosis of the operating state of the thermostat 61 is suspended in the abnormal state detecting process. That is, it is judged whether or not a flag (a diagnosis suspension flag FC) indicating that a determination of suspending the diagnosis of the operating state of the thermostat 61 is executed is set to the on state. When the diagnosis suspension flag FC is set to the on state, the process goes to step S314. When the diagnosis suspension flag FC is set to the off state, the present process is temporarily finished.

<Simulated Water Temperature Updating Process>

A description will be given in detail of a procedure of a simulated water temperature updating process in step S100 in FIG. 7 with reference to FIGS. 8 to 10.

Figure 8:
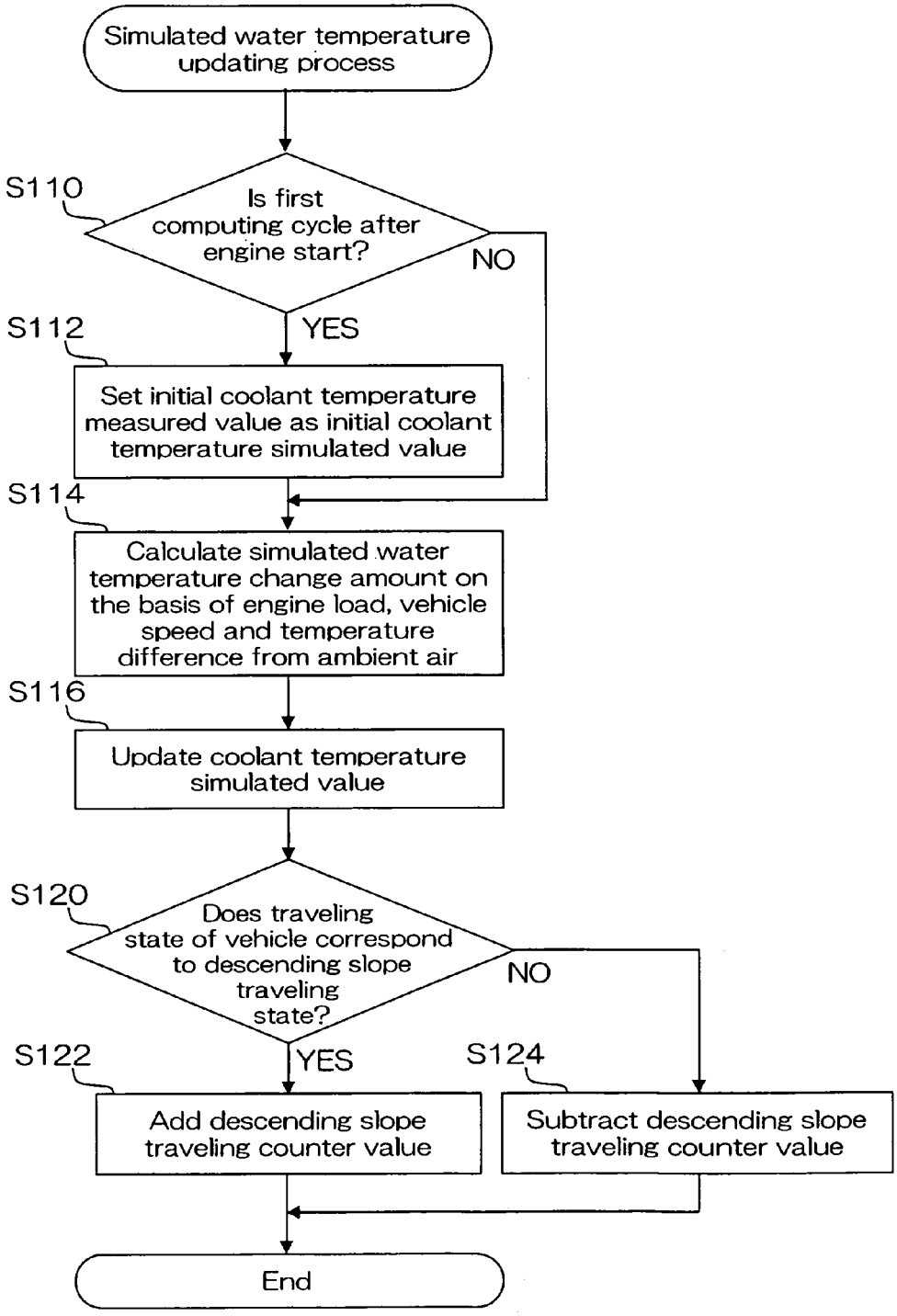
FIG. 8 is a flowchart showing a procedure of a simulated water temperature updating process executed in the first embodiment.

As shown in FIG. 8, it is judged whether or not the current computing cycle corresponds to a first computing cycle after starting the engine 2, in step S110. When it corresponds to the first computing cycle, the process goes to step S112. When it does not correspond to the first computing cycle, the process goes to step S114.

In step S112, an initial value (an initial coolant temperature measured value THWMini) of the coolant temperature measured value THWM is set as an initial value (an initial coolant temperature simulated value THWEini) of the coolant temperature simulated value THWE.

In step S114, the simulated water temperature change amount ΔTHWE is calculated on the basis of the engine load LE, the vehicle speed SPD and the temperature difference from the ambient air DfTHWA. Specifically, the simulated water temperature change amount ΔTHWE is calculated through processes of steps S114-1 and S114-2.

In step S114-1, parameters used for calculating the simulated water temperature change amount ΔTHWE are set. That is, an intake air rate GAP calculated from the intake flow rate measured value GAM and the maximum intake flow rate GAmax in the current computing cycle is set as the engine load LE. Also, the vehicle speed measured value SPDM in the current computing cycle is set as the vehicle speed SPD. Further, the temperature difference from the intake air DfTHWB calculated from the coolant temperature simulated value THWE and the minimum intake temperature measured value THAMmin in the current computing cycle is set as the temperature difference from the ambient air DfTHWA.

Figure 9:
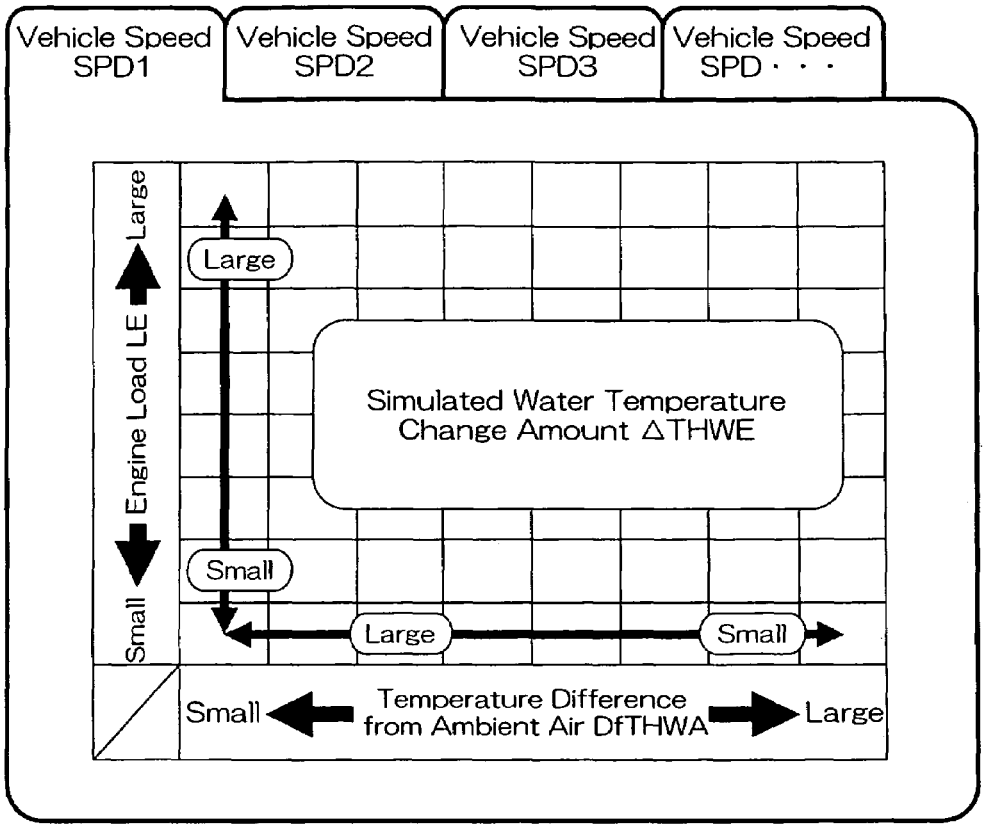
FIG. 9 is a simulated water temperature change amount calculating map used in the simulate water temperature updating process in FIG. 8.
Figure 10:
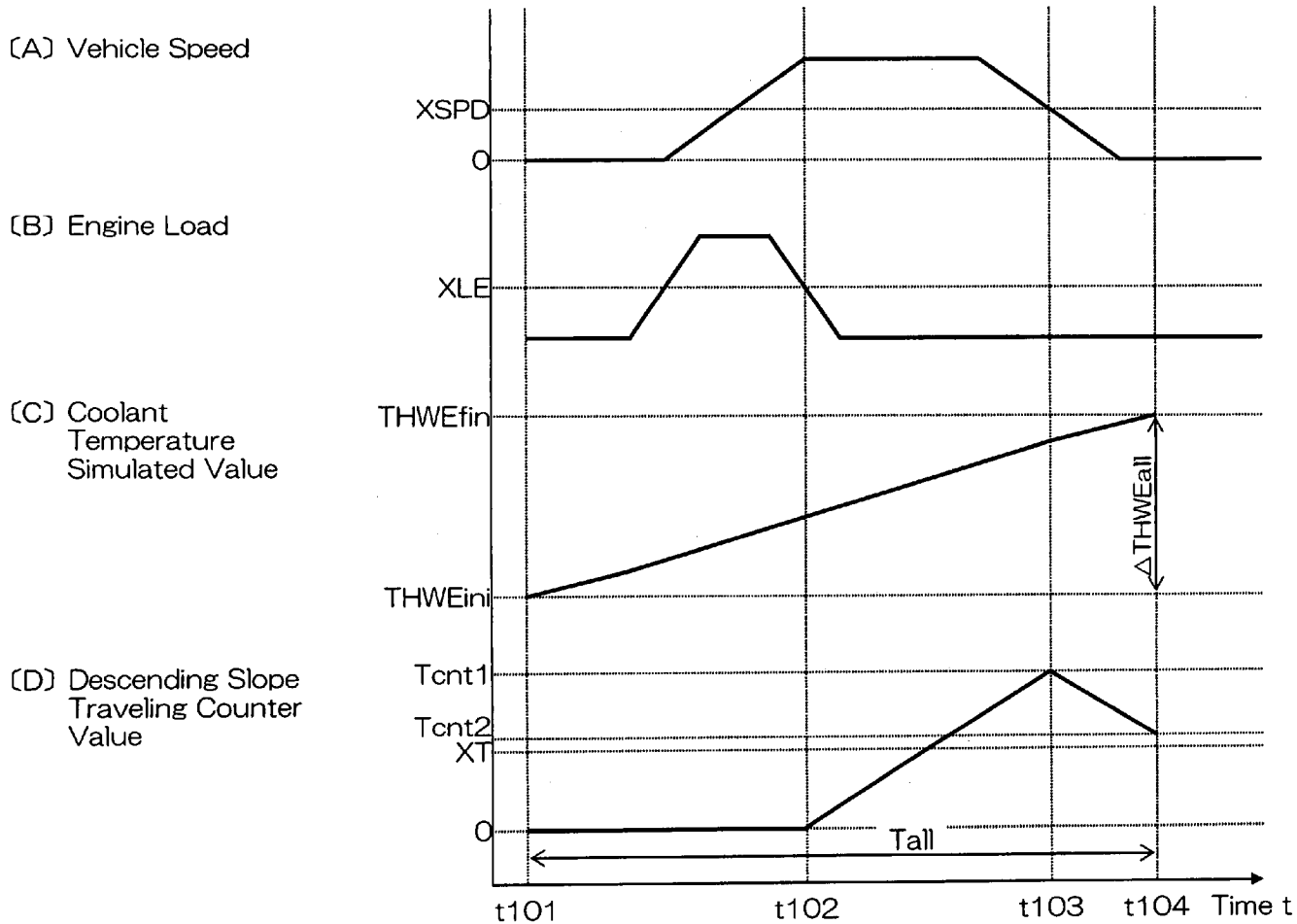
FIG. 10 is a timing chart showing one example of a calculating pattern of a traveling time counter value in the simulated water temperature updating process in FIG. 8.

In step S114-2, the simulated water temperature change amount ΔTHWE is calculated by applying the parameters set in step S114-1 to a simulated water temperature change amount calculating map in FIG. 9. In the simulated water temperature change amount calculating map, there are set a relation of the simulated water temperature change amount ΔTHWE with respect to the engine load LE, the vehicle speed SPD and the temperature difference from the ambient air DfTHWA. As shown in FIG. 9, the simulated water temperature change amount calculating map includes a plurality of two-dimensional maps prepared per a predetermined vehicle speed SPD. In each of the two-dimensional maps, there are set the relations of the simulated water temperature change amount ΔTHWE with respect to the engine load LE and the temperature difference from the ambient air DfTHWA.

The simulated water temperature change amount calculating map is structured by previously obtaining the relation between the parameters (the engine load LE, the temperature difference from the ambient air DfTHWA and the vehicle speed SPD) and the simulated water temperature change amount ΔTHWE through tests or the like. In the map, the relation between the parameters and the simulated water temperature change amount ΔTHWE is set as follows. That is, the coolant temperature THW is basically increased in accordance that the engine load LE is changed to a higher load. In the map mentioned above, the relation between the engine load LE and the simulated water temperature change amount ΔTHWE is set in accordance with a change tendency of the coolant temperature THW mentioned above. The coolant temperature THW is basically lowered in accordance that the temperature difference from the ambient air is enlarged. In the map mentioned above, the relation between the temperature difference from the ambient air DfTHWA and the simulated water temperature change amount ΔTHWE is set in accordance with a change tendency of the coolant temperature THW mentioned above. The coolant temperature THW is basically lowered in accordance that the vehicle speed SPD is changed to a higher speed. In the map mentioned above, the relation between the vehicle speed SPD and the simulated water temperature change amount ΔTHWE is set in accordance with a change tendency of the coolant temperature THW mentioned above.

In step S116, the coolant temperature simulated value THWE is updated by reflecting the simulated water temperature change amount ΔTHWE on the current coolant temperature simulated value THWE (the coolant temperature simulated value THWE calculated in the previous computing cycle). That is, the coolant temperature simulated value THWE is calculated through the following expression 1.

$$THWE \leftarrow THWE + \Delta THWE \qquad \text{expression 1}$$

In this case, in the present embodiment, the simulated water temperature change amount ΔTHWE is adapted in such a manner that a curve (a simulated water temperature curve LCC) obtained by tracing a transition of the coolant temperature simulated value THWE with respect to time is positioned between a curve (a normal water temperature curve LCA) obtained by tracing a transition of the actual coolant temperature THW at the normal state of the thermostat 61 and a curve (an abnormal water temperature curve LCB) obtained by tracing a transition of the actual coolant temperature THW at the abnormal state of the thermostat 61. That is, the coolant temperature simulated value THWE is updated in such a manner that a relation between the simulated water temperature curve LCC, the normal water temperature curve LCA and the abnormal water temperature curve LCB satisfied a relation shown in FIG. 6. Accordingly, the coolant temperature simulated value THWE calculated through the expression 1 indicates a value which is different from the actual coolant temperature THW at the normal state of the thermostat 61.

In step S120, it is judged whether or not the traveling state of the vehicle 1 corresponds to the descending slope traveling state. In this case, when the descending slope traveling condition (the following conditions (a) and (b)) is established, it is determined that the traveling state corresponds to the descending slope traveling state. On the other hand, when the descending slope traveling condition is not established, it is determined that the traveling state corresponds to other traveling states than the descending slope traveling state (general traveling state).

(a) the engine load LE is less than a determination value XLE (the engine 2 is in the low load operating state).

(b) the vehicle speed measured value SPDM is greater than or equal to a determination value XSPD (the vehicle speed SPD is comparatively large).

In the judging process in step S120, in the case that it is determined that the traveling state corresponds to the descending slope traveling state, the process goes to step S122, and in the case that it is determined that the traveling state corresponds to the general traveling state, the process goes to step S124.

In step S122, a descending slope traveling counter value Tcnt is increased by a value corresponding to an elapsed time from the previous computing cycle. That is, the descending slope traveling counter value Tcnt is updated through the following expression 2.

$$Tcnt \leftarrow Tcnt + \Delta T \qquad \text{expression 2}$$

In the expression 2 mentioned above, Tcnt in the right side indicates the descending slope traveling counter value Tcnt calculated in the previous computing cycle. Further, ΔT indicates a time interval between the previous computing cycle and the current computing cycle. In this case, the initial value of the descending slope traveling counter value Tcnt is set to zero.

In step S124, the descending slope traveling counter value Tcnt is reduced by a value corresponding to the elapsed time from the previous computing cycle. That is, the descending slope traveling counter value Tcnt is updated through the following expression 3.

$$Tcnt \leftarrow Tcnt - \Delta T \qquad \text{expression 3}$$

In the expression 3 mentioned above, Tcnt in the right side indicates the descending slope traveling counter value Tcnt calculated in the previous computing cycle. Further, ΔT indicates a time interval between the previous computing cycle and the current computing cycle. In this case, in the case that the descending slope traveling counter value Tcnt becomes less than zero on the basis of the subtraction, the descending slope traveling counter value Tcnt is set to zero.

Since the descending slope traveling counter value Tcnt is increased at the descending slope traveling state and reduced at the general traveling state, the descending slope traveling counter value Tcnt can be calculated as a value corresponding to a rate of the time of the descending slope traveling state with respect to an elapsed time (a total traveling time Tall) from the start of the engine 2. That is, it indicates that the rate of the descending slope traveling state after starting the engine 2 is greater in accordance that the descending slope counter value Tcnt is greater. On the contrary, it indicates that the rate of the general traveling state after starting the engine 2 is greater in accordance that the descending slope traveling counter value Tcnt is smaller.

A description will be given of one example of an updating process of the descending slope traveling counter value Tcnt with reference to FIG. 10. In FIG. 10, time t101 indicates a time when the operation of the engine 2 is started, time t102 indicates a point in time when the traveling state of the vehicle 1 is changed from the general traveling state to the descending slope traveling state, time t103 indicates a point in time when the traveling state of the vehicle 1 is changed from the descending slope traveling state to the general traveling state, and time t104 indicates a point in time of reaching a timing for executing the diagnosis of the operating state.

In the case that the traveling state of the vehicle 1 is changed as mentioned above, the descending slope traveling counter value Tcnt is updated as follows. That is, since the traveling state corresponds to the general traveling state in a period from the time t101 to the time t102, the descending slope traveling counter value Tcnt is held at the initial value of zero. Since the traveling state corresponds to the descending slope traveling state in a period from the time t102 to the time t103, the descending slope traveling counter value Tcnt is added. That is, the descending slope traveling counter value Tcnt is increased to the counter value Tcnt1 from the initial value of zero. Since the traveling state corresponds to the general traveling state in a period from the time t103 to the time t104, the descending slope traveling counter value Tcnt is subtracted. That is, the descending slope traveling counter value Tcnt is reduced to the counter value Tcnt2 from the counter value Tcnt1.

<Abnormal State Detecting Process>

A description will be given of a procedure of the abnormal state detecting process in step S200 in FIG. 7 with reference to FIG. 11.

In step S210, it is judged whether or not the time reaches the timing for executing the diagnosis of the operating state of the thermostat 61, that is, whether or not the diagnosis condition is established. That is, it is judged whether or not any one of the coolant temperature measured value THWM and the coolant temperature simulated value THWE reaches the diagnosis temperature THWD. In this case, in the following description, the coolant temperature simulated value THWE at the diagnosis timing of the operating state is set to the determination coolant temperature simulated value THWEfin.

The diagnosis temperature THWD is previously set through the test or the like. In the present embodiment, the configuration is made such that the diagnosis temperature THWD is set by assuming a standard valve opening temperature THWT (generally at 82° C.) of the thermostat 61 and adding a detection error or the like of the coolant temperature sensor 93 to the reference value. Specifically, a temperature (at 75° C. in this case) which is slightly lower than the reference value of the valve opening temperature THWT is set as a diagnosis temperature THWD. Accordingly, the diagnosis of the operating state is executed at an earliest timing to be expected, in the timing at which the normal thermostat is opened.

In the judging process in step S210, when any one of the coolant temperature measured value THWM and the coolant temperature simulated value THWE reaches the diagnosis temperature THWD, the process goes to step S220. On the other hand, when both of the coolant temperature measured value THWM and the coolant temperature simulated value THWE do not reach the diagnosis temperature THWD, the present process is temporarily finished.

In step S220, it is judged whether or not the descending slope traveling counter value Tcnt is greater than or equal to an upper limit time XT. In this case, the upper limit time XT is previously set as a value for judging whether or not the diagnosis of the operating state of the thermostat 61 can be accurately executed on the basis of the coolant temperature simulated value THWE, through the test or the like.

In the judging process in step S220, when the descending slope traveling counter value Tcnt is greater than or equal to the upper limit time XT, it corresponds to a state in which a rate of the time of the descending slope traveling state with respect to all the traveling time Tall is greater than or equal to the upper limit value. Accordingly, the electronic control unit 9 determines that it cannot accurately execute the diagnosis of the operating state. When this determination result is obtained, the process goes to step S222. On the other hand, when the descending slope traveling counter value Tcnt is less than the upper limit time XT, it corresponds to a state in which the rate of the time of the descending slope traveling state with respect to all the traveling time Tall is less than the upper limit value. Accordingly, the electronic control unit 9 determines that it can accurately execute the diagnosis of the operating state. When the determination result is obtained, the process goes to step S230.

It was confirmed through the test or the like executed by the present inventors that an affecting degree of the relative wind to the coolant temperature THW is greatly differentiated between the case that the traveling state of the vehicle 1 exists in the descending slope traveling state and the case that it exists in another traveling state. On the other hand, in the present embodiment, in order to reflect the influence of the relative wind on the coolant temperature THW (the coolant temperature simulated value THWE), a relation between the vehicle speed SPD having a correlation with the relative wind and the coolant temperature THW is previously mapped.

However, since the relationship between the vehicle speed SPD and the coolant temperature THW is univocally set under a state in which the descending slope traveling state of the vehicle 1 is not taken into consideration, in the case that the descending slope traveling state of the vehicle 1 is continued for a comparatively long period before the diagnosis timing, the following matters come into question. That is, since the coolant temperature simulated value THWE is updated on the basis of the simulated water temperature change amount ΔTHWE on which the influence of the actual relative wind is not properly reflected at a high degree, the determination coolant temperature simulated value THWEfin is largely deviated from the value to be essentially set. Accordingly, there is a risk that the abnormality of the thermostat 61 is erroneously detected.

Accordingly, in the present embodiment, it is judged whether or not a deviation degree between the current determination coolant temperature simulated value THWEfin and the essential determination coolant temperature simulated value THWEfin exists in an allowable range, through the comparison between the descending slope traveling counter value Tcnt and the upper limit time XT. Further, when the descending slope traveling counter value Tcnt is greater than or equal to the upper limit time XT, it is determined that a reliability of the current determination coolant temperature simulated value THWEfin is low, and the suspension (inhibition) of the diagnosis is set.

In step S222, the diagnosis suspension flag FC is set to the on state. In step S230, it is judged whether or not the coolant temperature simulated value THWE reaches the diagnosis temperature THWD prior to the coolant temperature measured value THWM. When the coolant temperature simulated value THWE reaches the diagnosis temperature THWD in advance, the process goes to step S232. On the other hand, when the coolant temperature measured value THWM reaches the diagnosis temperature THWD in advance, the process goes to step S234.

In step S232, the abnormality diagnosis flag FA is set to the on state. In step S234, the normality diagnosis flag FB is set to the on state. In this case, the flag set to the on state through the process of step S222, S232 or S234 is initialized (set to the off state) after the end of the operating state diagnosing process in step S314 in FIG. 7 before the start of the next operating state diagnosing process.

<Advantage of Embodiment>

In the present embodiment, when the descending slope traveling counter value Tcnt is greater than or equal to the upper limit time, the diagnosis of the operating state is suspended (inhibited). Accordingly, since it is possible to suppress the detection of the abnormality of the thermostat 61, it is possible to improve a detecting accuracy of the abnormality of the thermostat 61.

<Modifications of First Embodiment>

The first embodiment mentioned may be modified as shown below.

In the first embodiment, the configuration is made such that the diagnosis of the operating state is suspended at a time when the descending slope traveling counter value Tcnt is greater than or equal to the upper limit time at the diagnosis timing, however, can be changed, for example, such as the following first and second modifications. In this case, the electronic control unit 9 serves as a correcting section in the following modifications.

First modification: When the descending slope traveling counter value Tcnt is greater than or equal to the upper limit time XT at the diagnosis timing, the correction is executed in a direction of making the coolant temperature simulated value THWE (the determination coolant temperature simulated value THWEfin) smaller. Further, the diagnosis of the operating state is executed through the comparison between the corrected coolant temperature simulated value THWE and the coolant temperature measured value THWM.

Second modification: The correction is executed in a direction of making the coolant temperature simulated value THWE (the determination coolant temperature simulated value THWEfin) smaller whenever the descending slope traveling counter value Tcnt is greater than or equal to the upper limit time XT. In this case, after the correction, the descending slope traveling counter value Tcnt is set to the initial value of zero.

In the first and second modifications mentioned above, it is possible to change the correcting degree with respect to the coolant temperature simulated value THWE in correspondence to the magnitude of the descending slope traveling counter value Tcnt. In this case, the correction value of the coolant temperature simulated value THWE is set in accordance that the descending slope traveling counter value Tcnt becomes larger. That is, the coolant temperature simulated value THWE is corrected to the smaller value in accordance with the increase of the descending slope traveling counter value Tcnt.

In the first embodiment, the configuration is made such that the diagnosis of the operating state is suspended at a time when the descending slope traveling counter value Tcnt is greater than or equal to the upper limit time XT at the diagnosis timing, however, the configuration may be changed, for example, as follows. That is, the configuration may be made such that the updating of the coolant temperature simulated value THWE is continued by subtracting the coolant temperature simulated value THWE only by a fixed value, at a time when the descending slope traveling counter value Tcnt is greater than or equal to the upper limit time XT in the diagnosis timing. In this case, since it is possible to obtain a chance of again selecting the execution or the suspension of the diagnosis, it is possible to execute the diagnosis of the operating state in some updating processes of the traveling state of the vehicle 1 after subtracting the coolant temperature simulated value THWE.

Second Embodiment

A description will be given of a second embodiment in accordance with the present invention with reference to FIGS. 8, 11 and 12.

In the first embodiment, the suspension diagnosis of the operating state is selectively executed or suspended on the basis of the descending slope traveling counter value Tcnt. On the contrary, in the present embodiment, the diagnosis of the operating state is selectively executed or suspended on the basis of an integrated time of the descending slope traveling state (a descending slope traveling integrated time TA) from the start of the engine 2 to the diagnosis timing.

<Operating State Diagnosing Process>

In the operating state diagnosing process in accordance with the present embodiment, a process changed from the first embodiment is shown below.

A simulated water temperature updating process in FIG. 8 is changed in the following point. First, when the traveling state corresponds to the general traveling state in step S120, the simulated water temperature updating process is temporarily finished. That is, the process in step S124 is omitted.

The process in step S122 is changed to the following process. That is, the descending slope traveling integrated time TA is increased only by a value corresponding to the elapsed time from the previous computing cycle. That is, the descending slope traveling integrated time TA is updated through the following expression 4.

$$TA \leftarrow TA + \Delta T \qquad \text{expression 4}$$

In the expression 4 mentioned above, TA in the right side indicates the descending slope traveling integrated time TA calculated in the previous computing cycle. Further, ΔT indicates a time interval between the previous computing cycle and the current computing cycle. In this case, the initial value of the descending slope traveling integrated time TA is set to zero.

Figure 11:
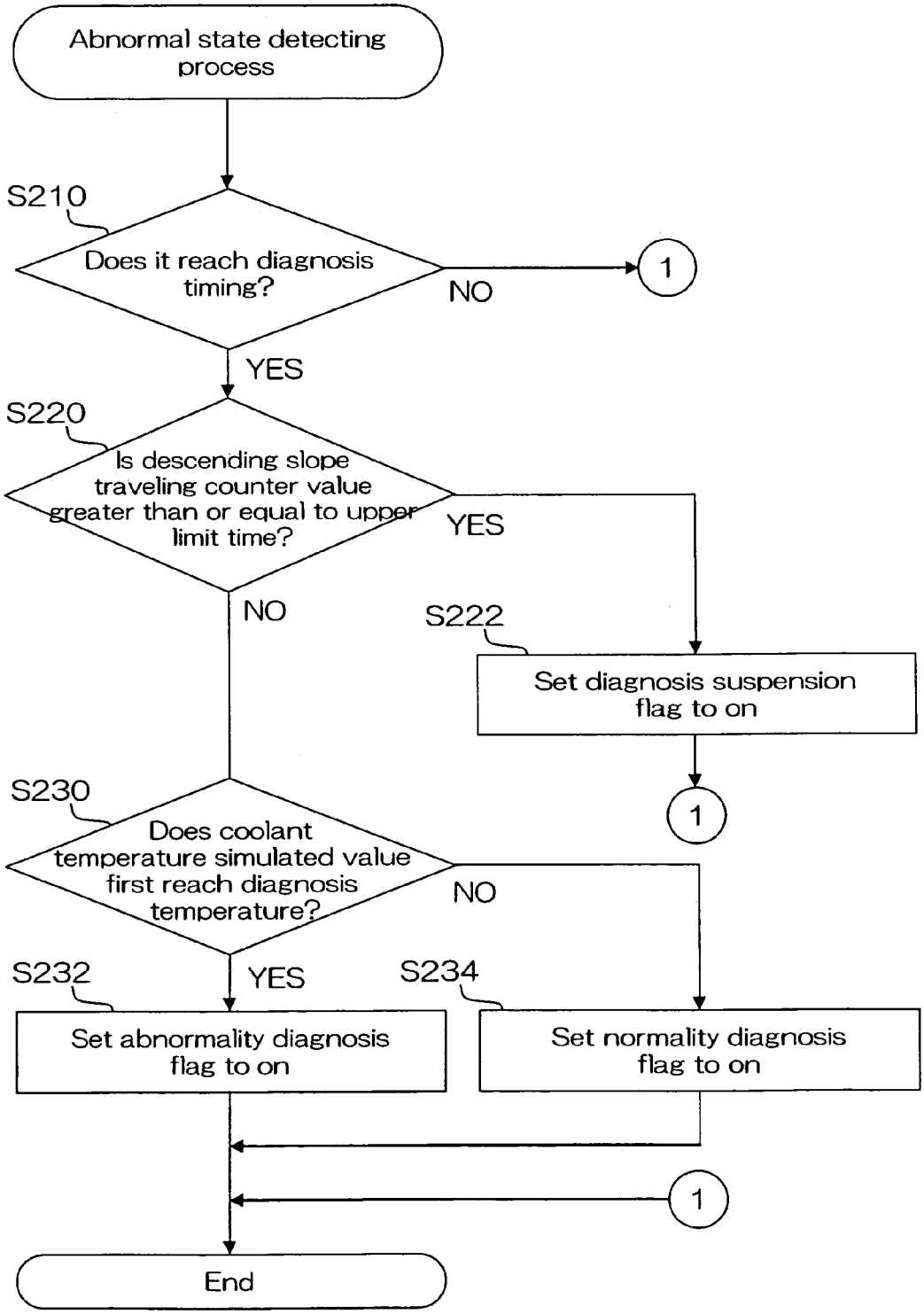
FIG. 11 is a flowchart showing a procedure of an abnormal state detecting process executed in the first embodiment.
Figure 12:
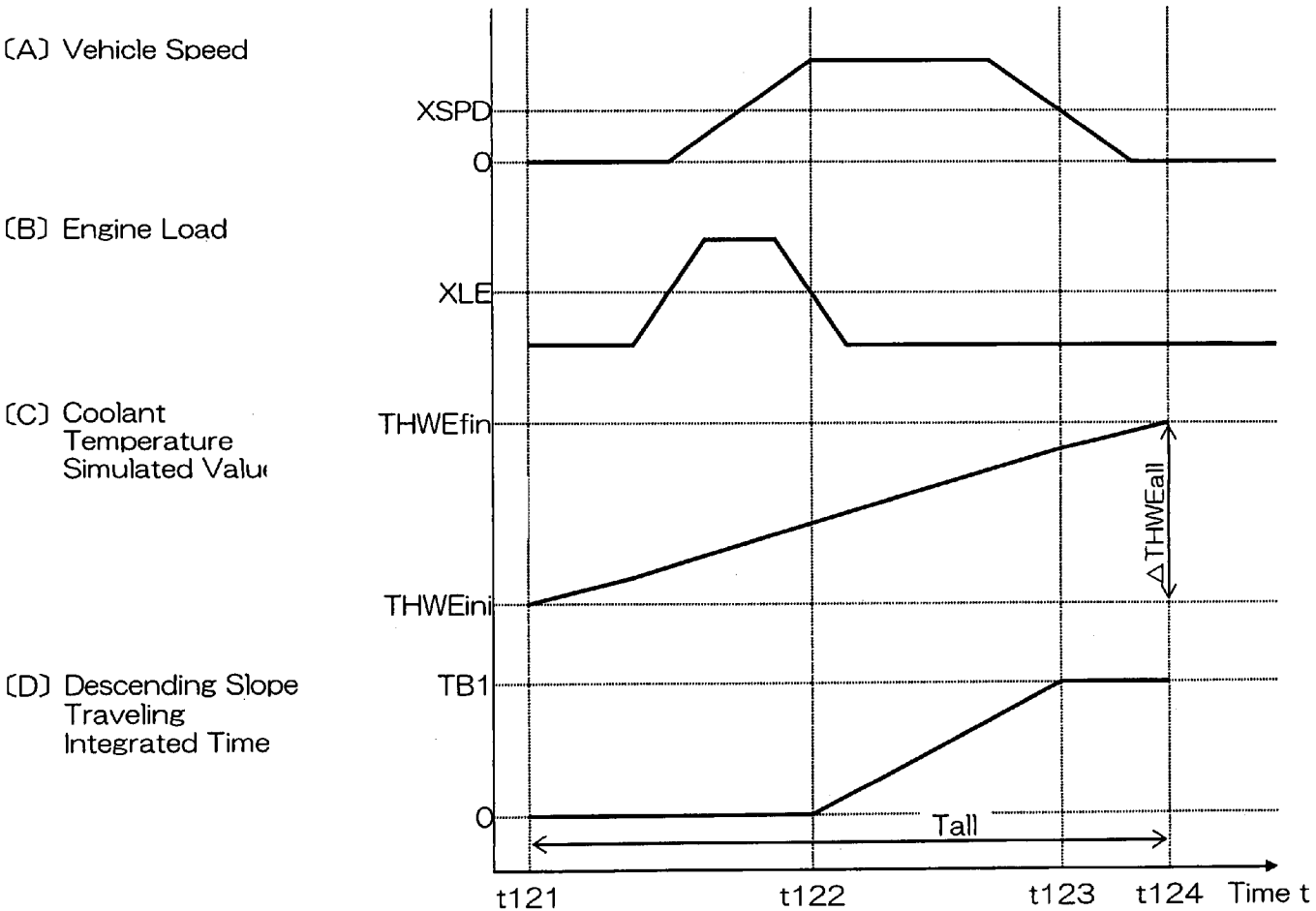
FIG. 12 is a timing chart showing one example of a calculating pattern of a descending slope traveling integrated time in accordance with a second embodiment of the present invention.

The abnormal state detecting process in FIG. 11 is changed in the following point. First, in step S210, when any one of the coolant temperature measured value THWM and the coolant temperature simulated value THWE reaches the diagnosis temperature THWD, the process goes to step S212. The process in step S212 corresponds to a process added to a flowchart in FIG. 11. In step S212, a rate (a descending slope traveling rate TP) of the descending slope traveling integrated time TA is calculated with respect to the elapsed time (a total traveling time Tall) from the start of the engine 2 to the diagnosis timing. That is, the descending slope traveling rate TP is calculated through the following expression 5.

$$TP \leftarrow TA/Tall \qquad \text{expression 5}$$

After calculating the descending slope traveling rate TP, the process goes to step S220. The process in step S220 is changed to the following process. That is, it is judged whether or not the descending slope traveling rate TP is greater than or equal to the upper limit rate. In this case, the upper limit rate XTP is previously set as a value for judging whether or not it is possible to accurately execute the diagnosis of the operating state of the thermostat 61 on the basis of the coolant temperature simulated value THWE, through the test or the like.

In the judging process in step S220, when the descending slope traveling rate TP is greater than or equal to the upper limit rate XTP, the electronic control unit 9 determines that it is impossible to accurately execute the diagnosis of the operating state. When the determination result is obtained, the process goes to step S222. On the other hand, when the descending slope traveling rate TP is less than the upper limit rate XTP, the electronic control unit 9 determines that it is possible to accurately execute the diagnosis of the operating state. When this determination result is obtained, the process goes to step S230.

<Updating Process of Integrated Time>

A description will be given of one example of the updating process of the descending slope traveling integrated time TA with reference to FIG. 12. In FIG. 12, time t121 indicates a point in time when the operation of the engine 2 is started, time t122 indicates a point in time when the traveling state of the vehicle 1 is changed from the general traveling state to the descending slope traveling state, time t123 indicates a point in time when the traveling state of the vehicle 1 is changed from the descending slope traveling state to the general traveling state, and time t124 indicates a point in time of reaching a timing for executing the diagnosis of the operating state.

In the case that the traveling state of the vehicle 1 is changed as mentioned above, the descending slope traveling integrated time TA is updated as follows. That is, since the traveling state corresponds to the general traveling state in a period from the time t121 to the time t122, the descending slope traveling integrated time TA is held at the initial value of zero. Since the traveling state corresponds to the descending slope traveling state in a period from the time t122 to the time t123, the descending slope traveling integrated time TA is added. That is, the descending slope traveling integrated time TA is increased to the integrated time TA from the initial value of zero. Since the traveling state corresponds to the general traveling state in a period from the time t123 to the time t124, the descending slope traveling integrated time TA is held. That is, the descending slope traveling integrated time TA is held in the integrated time TA1.

In accordance with the second embodiment which is in detailed described above, it is possible to obtain the same advantage as the advantage mentioned in the item (1) in accordance with the first embodiment.

<Modifications of Second Embodiment>

The second embodiment mentioned above may be modified as shown below.

In the second embodiment, the configuration is made such that the diagnosis of the operating state is suspended at a time when the descending slope traveling rate TP is greater than or equal to the upper limit rate XTP at the diagnosis timing, however, can be changed, for example, such as the following modification. In this case, the electronic control unit 9 serves as a correcting section in the following modification.

Modification: When the descending slope traveling rate TP is greater than or equal to the upper limit rate XTP at the diagnosis timing, the correction is executed in a direction of making the coolant temperature simulated value THWE (the determination coolant temperature simulated value THWE-fin) smaller. Further, the diagnosis of the operating state is executed through the comparison between the corrected coolant temperature simulated value THWE and the coolant temperature measured value THWM.

In the modification mentioned above, it is possible to change the correcting degree with respect to the coolant temperature simulated value THWE in correspondence to the magnitude of the descending slope traveling rate TP. In this case, the correction value of the coolant temperature simulated value THWE is set in accordance that the descending slope traveling rate TP becomes larger. That is, the coolant temperature simulated value THWE is corrected to the smaller value in accordance with the increase of the descending slope traveling rate TP.

Third Embodiment

Figure 13:
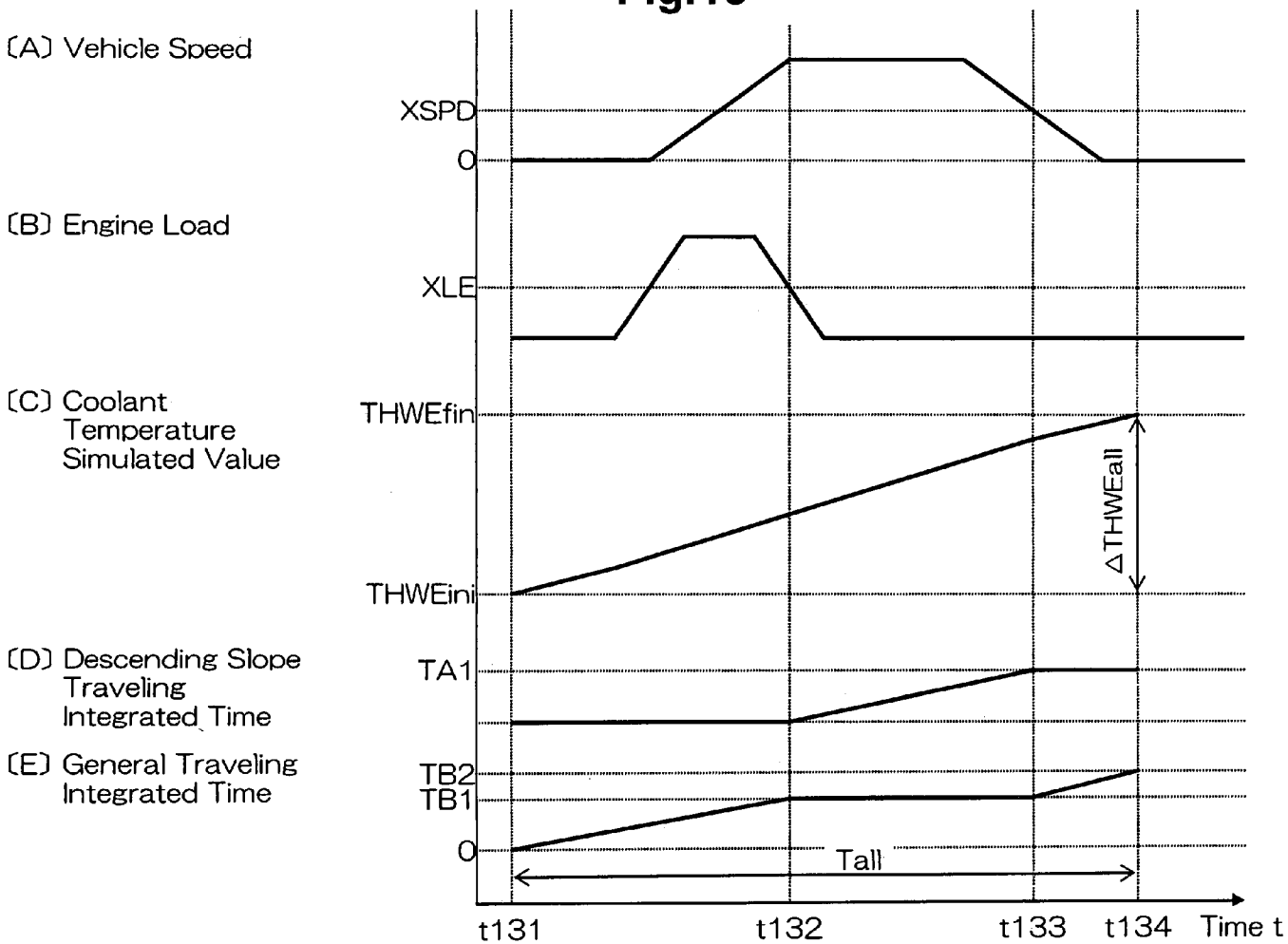
FIG. 13 is a timing chart showing one example of a calculating pattern of a descending slope traveling integrated time and a general traveling integrated time in accordance with a third embodiment of the present invention.

A description will be given of a third embodiment in accordance with the present invention with reference to FIGS. 8, 11 and 13.

In the first embodiment, the diagnosis of the operating state is selectively executed or suspended on the basis of the descending slope traveling counter value Tcnt. On the contrary, in the present embodiment, the diagnosis of the operating state is selectively executed or suspended on the basis of an integrated time of the descending slope traveling state (a descending slope traveling integrated time TA) from the start of the engine 2 to the diagnosis timing, and an integrated time of the general traveling state (a general traveling integrated time TB).

<Operating State Diagnosing Process>

In the operating state diagnosing process in accordance with the present embodiment, processes changed from and added to the first embodiment are shown below.

A simulated water temperature updating process in FIG. 8 is changed in the following point. First, in step S122, the descending slope traveling integrated time TA is increased at a degree corresponding to the elapsed time from the previous computing cycle. That is, the descending slope traveling integrated time TA is updated through the following expression 6.

$$TA \leftarrow TA + \Delta T \qquad \text{expression 6}$$

In the expression 6 mentioned above, TA in the right side indicates the latest descending slope traveling integrated time TA calculated before the current computing cycle. Further, ΔT indicates a time interval between the previous computing cycle and the current computing cycle. In this case, the initial value of the descending slope traveling integrated time TA is set to zero.

In step S214, the general traveling integrated time TB is increased by a value corresponding to the elapsed time from the previous computing cycle. That is, the general traveling integrated time TB is updated through the following expression 7.

$$TB \leftarrow TB + \Delta T \qquad \text{expression 7}$$

In the expression 7 mentioned above, TB in the right side indicates the latest general traveling integrated time TB calculated before the current computing cycle. Further, ΔT indicates the time interval between the previous computing cycle and the current computing cycle. In this case, the initial value of the general traveling integrated time TB is set to zero.

The abnormal state detecting process in FIG. 11 is changed in the following point. First, in step S210, when any one of the coolant temperature measured value THWM and the coolant temperature simulated value THWE reaches the diagnosis temperature THWD, the process goes to step S212. The process in step S212 corresponds to a process added to a flowchart in FIG. 11. In step S212, a rate (a descending slope traveling ratio TR) of the descending slope traveling integrated time TA with respect to the general traveling integrated time TB is calculated. That is, the descending slope traveling ratio TR is calculated through the following expression 8.

$$TR \leftarrow TA/TB \qquad \text{expression 8}$$

After calculating the descending slope traveling ratio TR, the process goes to step S220. The process in step S220 is changed to the following process. That is, it is judged whether or not the descending slope traveling ratio TR is greater than or equal to the upper limit ratio XTR. In this case, the upper limit ratio XTR is previously set as a value for judging whether or not it is possible to accurately execute the diagnosis of the operating state of the thermostat 61 on the basis of the coolant temperature simulated value THWE, through the test or the like.

In the judging process in step S220, when the descending slope traveling ratio TR is greater than or equal to the upper limit ratio XTR, the electronic control unit 9 determines that it is impossible to accurately execute the diagnosis of the operating state. When the determination result is obtained, the process goes to step S222. On the other hand, when the descending slope traveling ratio TR is less than the upper limit ratio XTR, the electronic control unit 9 determines that it is possible to accurately execute the diagnosis of the operating state. When this determination result is obtained, the process goes to step S230.

<Updating Process of Integrated Time>

A description will be given of one example of the updating process of the descending slope traveling integrated time TA and the general traveling integrated time TB with reference to FIG. 13. In FIG. 13, time t131 indicates a point in time when the operation of the engine 2 is started, time t132 indicates a point in time when the traveling state of the vehicle 1 is changed from the general traveling state to the descending slope traveling state, time t133 indicates a point in time when the traveling state of the vehicle 1 is changed from the descending slope traveling state to the general traveling state, and time t134 indicates a point in time of reaching a timing for executing the diagnosis of the operating state.

In the case that the traveling state of the vehicle 1 is changed as mentioned above, the descending slope traveling integrated time TA and the general traveling integrated time TB are respectively updated as follows. That is, since the traveling state corresponds to the general traveling state in a period from the time t131 to the time t132, the general traveling integrated time TB is increased to the integrated time TB1 from the initial value of zero. On the other hand, the descending slope traveling integrated time TA is held at the initial value of zero. Since the traveling state corresponds to the descending slope traveling state in a period from the time t132 to the time t133, the descending slope traveling integrated time TA is increased to the integrated time TA1 from the initial value of zero. On the other hand, the general traveling integrated time TB is held at the integrated time TB1. Since the traveling state corresponds to the general traveling state in a period from the time t133 to the time t134, the general traveling integrated time TB is increased to the integrated time TB2 from the integrated time TB1. On the other hand, the descending slope traveling integrated time TA is held at the integrated time TA1.

In accordance with the third embodiment which is in detailed described above, it is possible to obtain the same advantage as the advantage mentioned in the item (1) in accordance with the first embodiment.

<Modifications of Third Embodiment>

The third embodiment mentioned above may be modified as shown below.

In the third embodiment, the configuration is made such that the diagnosis of the operating state is suspended at a time when the descending slope traveling ratio TR is greater than or equal to the upper limit ratio XTR at the diagnosis timing, however, can be changed, for example, such as the following modification. In this case, the electronic control unit 9 serves as a correcting section in the following modification.

Modification: When the descending slope traveling ratio TR is greater than or equal to the upper limit ratio XTR at the diagnosis timing, the correction is executed in a direction of making the coolant temperature simulated value THWE (the determination coolant temperature simulated value THWEfin) smaller. Further, the diagnosis of the operating state is executed through the comparison between the corrected coolant temperature simulated value THWE and the coolant temperature measured value THWM.

In the modification mentioned above, it is possible to change the correcting degree with respect to the coolant temperature simulated value THWE in correspondence to the magnitude of the descending slope traveling ratio TR. In this case, the correction value of the coolant temperature simulated value THWE is set in accordance that the descending slope traveling ratio TR becomes larger. That is, the coolant temperature simulated value THWE is corrected to the smaller value in accordance with the increase of the descending slope traveling ratio TR.

Other Embodiments

In addition, the elements which can be changed in common to the embodiments mentioned above will be shown as follows.

In the embodiments mentioned above, the conditions of the items (a) and (b) in step S120 are employed as the descending slope traveling condition, however, the descending slope traveling condition is not limited to the exemplified conditions but can be approximately changed. Further, it is possible to detect the descending slope traveling state through the sensor.

In the embodiments mentioned above, the configuration is made such that the diagnosis temperature THWD is set on the basis of the reference value of the valve opening temperature THWT, however, an appropriate value may be employed as the diagnosis temperature THWD.

In the embodiments mentioned above, the configuration is made such that the diagnosis timing of the operating state is set on the basis of the parameter (the coolant temperature measured value THWM and the coolant temperature simulated value THWE) being relevant to the coolant temperature THW, however, the diagnosis timing is not limited to the parameter mentioned above, but can be set on the basis of an appropriate parameter (for example, a traveling time of the vehicle 1).

In the embodiments mentioned above, the present invention is applied to the cooling apparatus for the engine directly injecting the fuel to the combustion chamber, however, the present invention can be applied to whatever engine provided with the cooling apparatus including the engine injecting the fuel to the intake port. Even in this case, it is possible to achieve the operation and effect in proportion to the operation and effect of the embodiment by applying the present invention on the basis of the aspect in proportion to the embodiments mentioned above.

The invention claimed is:

1. A cooling apparatus for an internal combustion engine, the cooling apparatus comprising:

a radiator through which a coolant passes;

a thermostat operating in such a manner as to control a supply of the coolant to the radiator;

a temperature detector detecting a temperature of the coolant;

an estimating section estimating a reference temperature corresponding to the temperature of the coolant on the basis of at least a vehicle speed;

an diagnosing section diagnosing an operating state of the thermostat on the basis of a comparison between the detected temperature and the reference temperature in the case that a predetermined diagnosis condition is established; and an inhibiting section inhibiting the diagnosis of the operating state of the thermostat in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general traveling time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

2. The cooling apparatus according to claim 1, wherein the inhibiting section inhibits the diagnosis of the operating state of the thermostat in the case that the condition i) is satisfied.

3. The cooling apparatus according to claim 1, wherein the inhibiting section inhibits the diagnosis of the operating state of the thermostat in the case that the condition ii) is satisfied.

4. The cooling apparatus according to claim 1, wherein the inhibiting section inhibits the diagnosis of the operating state of the thermostat in the case that the condition iii) is satisfied.

5. The cooling apparatus according to claim 1, wherein the estimating section estimates the reference temperature on the assumption that no abnormality is generated in the thermostat.

6. A cooling apparatus for an internal combustion engine, the cooling apparatus comprising:

a radiator through which a coolant passes;

a thermostat operating in such a manner as to control a supply of the coolant to the radiator;

a temperature detector detecting a temperature of the coolant;

an estimating section estimating a reference temperature corresponding to the temperature of the coolant on the basis of at least a vehicle speed;

an diagnosing section diagnosing an operating state of the thermostat on the basis of a comparison between the detected temperature and the reference temperature in the case that a predetermined diagnosis condition is established; and a correcting section correcting the reference temperature in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

7. The cooling apparatus according to claim 6, wherein the correcting section corrects the reference temperature in the case that the condition i) is satisfied.

8. The cooling apparatus according to claim 7, wherein the correcting section increases a correcting degree of the reference temperature in accordance with an increase of the descending slope traveling time.

9. The cooling apparatus according to claim 6, wherein the correcting section corrects the reference temperature in the case that the condition ii) is satisfied.

10. The cooling apparatus according to claim 9, wherein the correcting section increases a correcting degree of the reference temperature in accordance with an increase of a rate of the descending slope traveling time.

11. The cooling apparatus according to claim 6, wherein the correcting section corrects the reference temperature in the case that the condition iii) is satisfied.

12. The cooling apparatus according to claim 11, wherein the correcting section increases a correcting degree of the reference temperature in accordance with an increase of a rate of a time of the specific state.

13. The cooling apparatus according to claim 6, wherein the correcting section corrects in a direction of reducing the reference temperature.

14. The cooling apparatus according to claim 6, wherein the estimating section estimates the reference temperature on the assumption that no abnormality is generated in the thermostat.

15. A diagnosis method of a cooling apparatus for an internal combustion engine, the cooling apparatus including a radiator through which a coolant passes, and a thermostat operating in such a manner as to control a supply of the coolant to the radiator, the diagnosis method comprising:

detecting a temperature of the coolant;

estimating a reference temperature corresponding to the temperature of the coolant on the basis of at least a vehicle speed;

diagnosing an operating state of the thermostat on the basis of a comparison between the detected temperature and the reference temperature in the case that a predetermined diagnosis condition is established; and inhibiting the diagnosis of the operating state of the thermostat in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general traveling time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

16. A diagnosis method of a cooling apparatus for an internal combustion engine, the cooling apparatus including a radiator through which a coolant passes, and a thermostat operating in such a manner as to control a supply of the coolant to the radiator, the diagnosis method comprising:

detecting a temperature of the coolant;

estimating a reference temperature corresponding to the temperature of the coolant on the basis of at least a vehicle speed;

diagnosing an operating state of the thermostat on the basis of a comparison between the detected temperature and the reference temperature in the case that a predetermined diagnosis condition is established; and correcting the reference temperature in the case that any one of the following conditions i) to iii) is satisfied.

i) a rate of a descending slope traveling time with respect to a time until the diagnosis condition is established from the start of the internal combustion engine is greater than or equal to a determination value, in which the descending slope traveling time indicates a time for which a vehicle is under the descending slope traveling state;

ii) a rate of the descending slope traveling time with respect to a general traveling time is greater than or equal to a determination value, in which the general traveling time indicates a time for which the vehicle is under any traveling state other than the descending slope traveling state; and iii) a rate of a time of a specific state with respect to the time until the diagnosis condition is established from the start of the internal combustion engine is greater than or equal to a determination value, in which the specific state indicates a state in which a speed of the vehicle is greater than or equal to a reference vehicle speed and a load of the internal combustion engine is less than a reference load.

* * * * *